US010779634B1

(12) United States Patent
Kawamoto et al.

(10) Patent No.: US 10,779,634 B1
(45) Date of Patent: Sep. 22, 2020

(54) BUCKET BACKPACK

(71) Applicant: PEREGRINE OUTDOOR PRODUCTS, LLC, Lebanon, OH (US)

(72) Inventors: Steven A. Kawamoto, Franklin, OH (US); James H. Lua, Columbus, OH (US)

(73) Assignee: Peregrine Outdoor Products, LLC, Lebanon, OH (US)

( * ) Notice: Subject to any disclaimer, the term of this patent is extended or adjusted under 35 U.S.C. 154(b) by 0 days.

(21) Appl. No.: 16/437,269

(22) Filed: Jun. 11, 2019

Related U.S. Application Data

(62) Division of application No. 29/663,081, filed on Sep. 12, 2018.

(51) Int. Cl.
*A45F 3/04* (2006.01)
*A45F 3/12* (2006.01)

(52) U.S. Cl.
CPC ..... *A45F 3/04* (2013.01); *A45F 3/12* (2013.01); *A45F 2003/122* (2013.01)

(58) Field of Classification Search
CPC ..... A45F 3/04; A45F 2003/122; A45F 2004/026; A45F 3/047; A45F 3/08; A45F 4/02; A45F 2003/142; A45F 2003/003
See application file for complete search history.

(56) References Cited

U.S. PATENT DOCUMENTS

D277,901 S 3/1985 Leslie
5,431,317 A * 7/1995 Kliot ..... A45F 3/02 224/153
D398,148 S 9/1998 Jones et al.
6,092,661 A 7/2000 Mogil
6,394,328 B1 * 5/2002 Zakarin ..... A45F 3/04 150/108
6,536,590 B1 3/2003 Godshaw et al.
D506,865 S 7/2005 Homsher et al.
6,938,761 B2 * 9/2005 Nish ..... A45C 3/00 206/315.11
7,431,313 B1 10/2008 Torres et al.
7,537,143 B1 * 5/2009 Collier ..... A45F 3/08 224/633
7,832,663 B1 11/2010 Cotham
8,251,269 B2 * 8/2012 Winneur ..... A45C 9/00 224/629
9,072,366 B2 7/2015 Jensen et al.
D764,873 S * 8/2016 Collie ..... D7/607
9,415,294 B2 * 8/2016 Pino ..... A63C 17/002
D772,561 S 11/2016 Polunsky et al.
D772,562 S 11/2016 Petre
(Continued)

*Primary Examiner* — Adam J Waggenspack
(74) *Attorney, Agent, or Firm* — Tuggle Duggins P.A.; Blake P. Hurt

(57) ABSTRACT

A backpack for a cylindrical shaped object, such as a utility bucket, is disclosed and includes a generally cylindrical shaped body portion with an open top and a bottom and a pair of a pair of shoulder straps attached to the top and bottom of the body portion, the attachment points for the straps at the top are spaced apart by at least a hundred and sixty degrees (160°) and eighty degrees (80°) from a lateral center line of the body portion relative to one another. A plurality of pockets may be disposed about the perimeter of the body portion and the backpack may also include a grab handle and chest strap.

19 Claims, 7 Drawing Sheets

(56) References Cited

U.S. PATENT DOCUMENTS

| | | | | |
|---|---|---|---|---|
| D780,453 | S | 3/2017 | Carrasco | |
| 9,993,052 | B2 * | 6/2018 | Williams | A45B 11/02 |
| D835,397 | S | 12/2018 | Kawamoto et al. | |
| 10,194,733 | B2 * | 2/2019 | Robert | A45F 3/08 |
| 2007/0205234 | A1 | 9/2007 | Lessmann | |
| 2014/0076942 | A1 * | 3/2014 | Hurt | A45F 3/04 224/155 |
| 2017/0311703 | A1 | 11/2017 | Wistrand | |

* cited by examiner

BUCKET BACKPACK

This is a division of and claims benefits under pending prior application Ser. No. 29/663,081 filed 12 Sep. 2018, which is incorporated by reference in its entirety herein.

FIELD OF THE INVENTION

This invention relates to covers for utility buckets and more particularly relates to backpacks suited for use with utility buckets and the like that reduce uncomfortable bucket movement while walking and running.

DESCRIPTION OF THE PRIOR ART AND OBJECTIVES OF THE INVENTION

Covers for utility buckets have existed for some time. One traditional use of a utility bucket cover is to allow a handyman to store and access tools more readily. Most traditional utility bucket covers are secured over the outside wall of the utility bucket so that tools and other implements can be stored inside the bucket, while various pockets and other receptacles provided on the cover will hold additional tools and implements on the outside of the bucket.

Sportsmen have been known to use utility buckets. For example, ice fishermen and hunters often carried their equipment and gear inside of the utility bucket. When a fisherman arrives at his or her preferred fishing destination, the fisherman often empties the contents of the bucket, inverts the bucket, and sits on top of the bucket while he or she fishes. Others, including sportsmen, construction workers, gardeners, etc., will use the utility bucket in a similar fashion. Thus, the bucket serves the dual purpose of carrying equipment and providing a seat once in the field.

There are problems associated with utilizing traditional utility bucket covers on utility buckets to carry implements and to use as a seat while fishing. If items are placed inside of the pockets of a traditional utility bucket cover, as soon as the bucket is inverted for seating purposes, the contents of the pockets will fall out. Another problem associated with traditional utility bucket covers is that there is no padding or protection when the bucket is used as a seat. When inverting a traditional bucket for seating purposes, only the hard plastic bottom surface of the bucket is available for the sportsman to sit on. Yet another problem associated with traditional sportsmen utility buckets relates to the difficulty in carrying the bucket. While carrying a utility bucket by the bucket handle is certainly manageable for short periods, extended trips are more difficult. Furthermore, carrying the bucket by the handle requires use of at least one arm and hand, often leading to hand and arm fatigue. Further still, the handle conventionally associated with the typical bucket wears out and breaks down over time due to repeated use, eventually breaking and requiring replacement.

The foregoing problems associated with traditional utility bucket covers gave rise to the development of an improved utility bucket cover for use by sportsmen. Such improvements included the addition of shoulder straps to the bucket cover so that the bucket could be carried like a backpack, and the addition of a padded lid for the bucket to provide a more comfortable seating surface.

While these improvements provided many benefits to the prior bucket covers, the addition of straps in particular created a new set of problems. In particular, the prior art backpack style bucket covers had poor weight distribution for the loaded bucket. The poor weight distribution created a tendency for the bucket, when worn, to pivot outwardly away from the shoulders of the user, applying pressure to the lower back and causing the lower edge of the bucket to frictionally engage with the user's back. In addition, the straps were positioned close to the centerline of the cover, which resulted in excessive movement of the bucket in the vertical and/or horizontal direction, such as when the user was walking with a full bucket. The excessive vertical and/or horizontal movement can result in discomfort or injury to the user. All of the aforementioned problems result from the reduced total surface area of the bucket in contact with the user's back, leading to discomfort.

Thus, there is a need to develop a utility bucket cover that can be worn like a backpack, but which reduces or eliminates the tendency of prior art covers to pull away from the user and reduces or eliminates the vertical and/or horizontal movement while in use.

It is another objective of the present invention to provide a cover for a utility bucket that can be worn like a backpack that has improved weight distribution.

It is yet another objective of the present invention to provide a cover for a utility bucket that can be worn like a backpack that has minimal vertical and/or horizontal movement when being worn and used.

Various other objectives and advantages of the present invention will become apparent to those skilled in the art as a more detailed description is set forth below.

SUMMARY OF THE INVENTION

In a preferred embodiment, the present invention includes a backpack comprising a generally cylindrical body sized for positioning around the outside cylindrical wall of a standard utility bucket. The body has a plurality of pockets positioned about the outer circumferential surface thereof. A pair of padded shoulder straps are ergonomically positioned more outboard of the configuration typical in the prior art and is affixed to the body to facilitate carrying the cover on the back of a user. The shoulder straps are affixed at one end to the top of the cover and at a second end to the bottom of the cover. Ideally, the distal or outermost points of attachment of the straps to the cover are spaced apart at an angle of about eighty (80) degrees relative to the midline of the cover.

DETAILED DESCRIPTION OF THE PREFERRED EMBODIMENT AND OPERATION OF THE INVENTION

Figure 1:
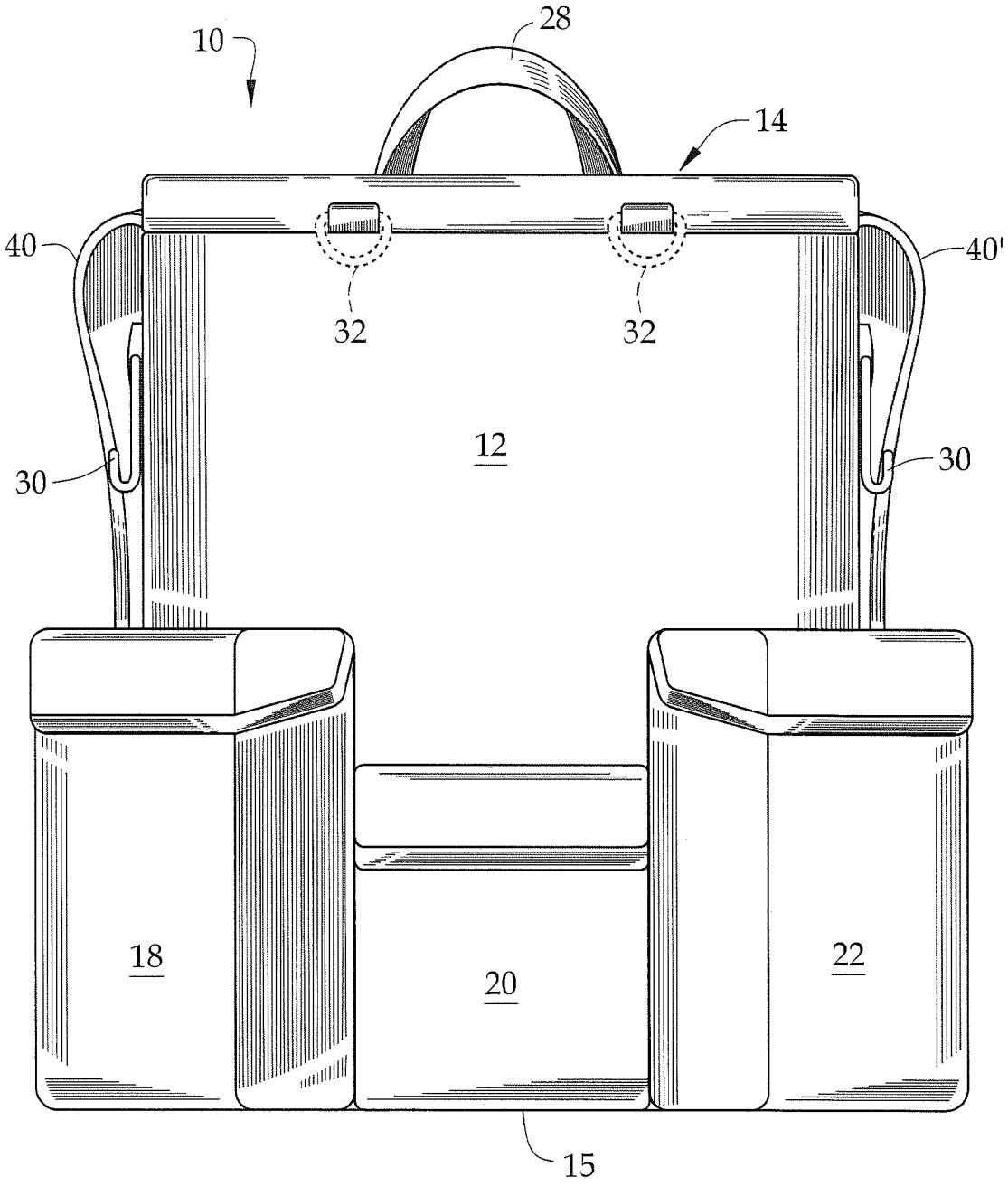
FIG. 1 is as front elevational view of a preferred embodiment of a bucket backpack according to the invention.

Various exemplary embodiments of the present disclosure are described below. Use of the term "exemplary" means illustrative or by way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily includes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these teens are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific term is are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the teams "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

Figure 3:
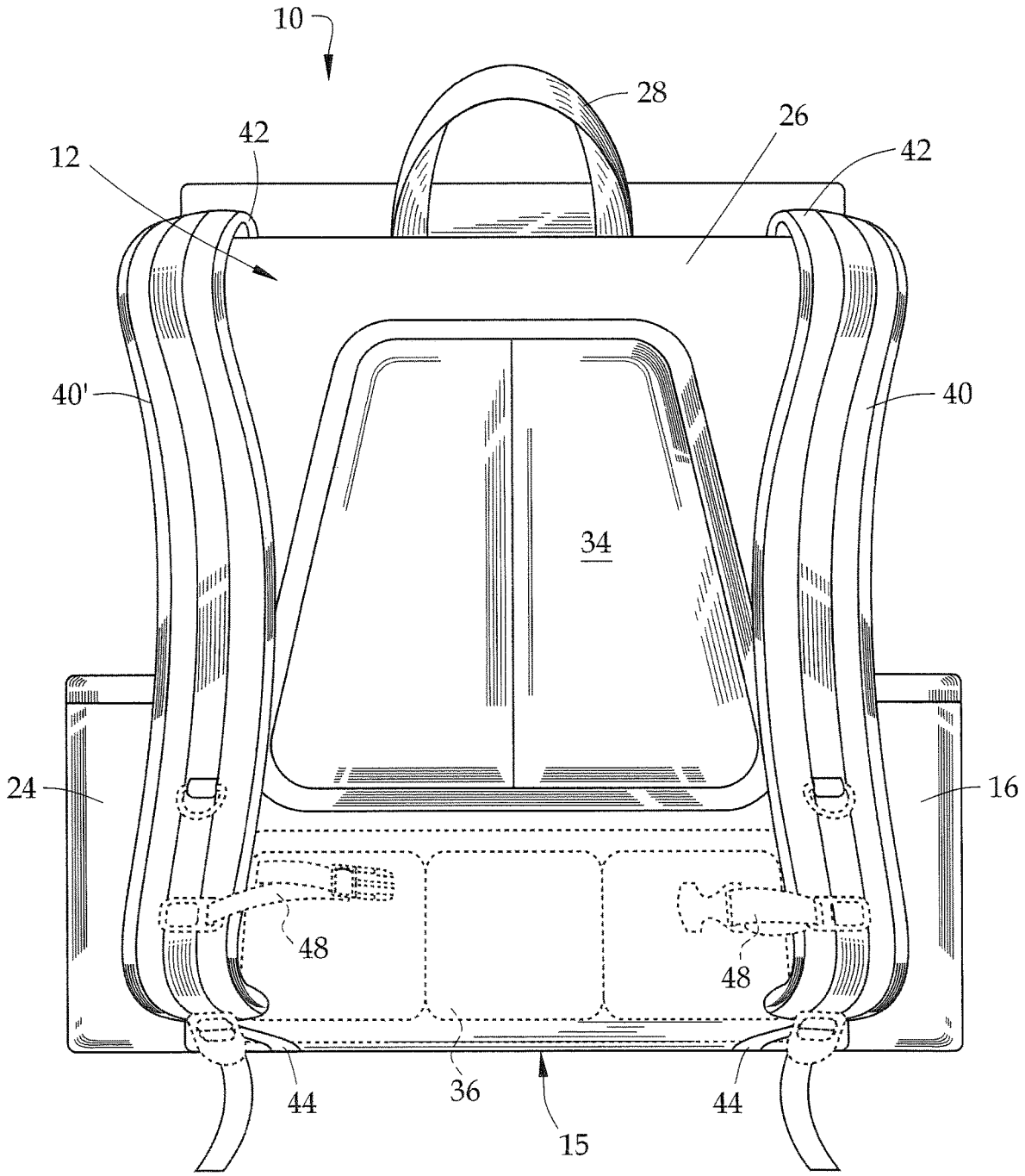
FIG. 3 is a rear elevational view of the embodiment of FIG. 1.
Figure 4:
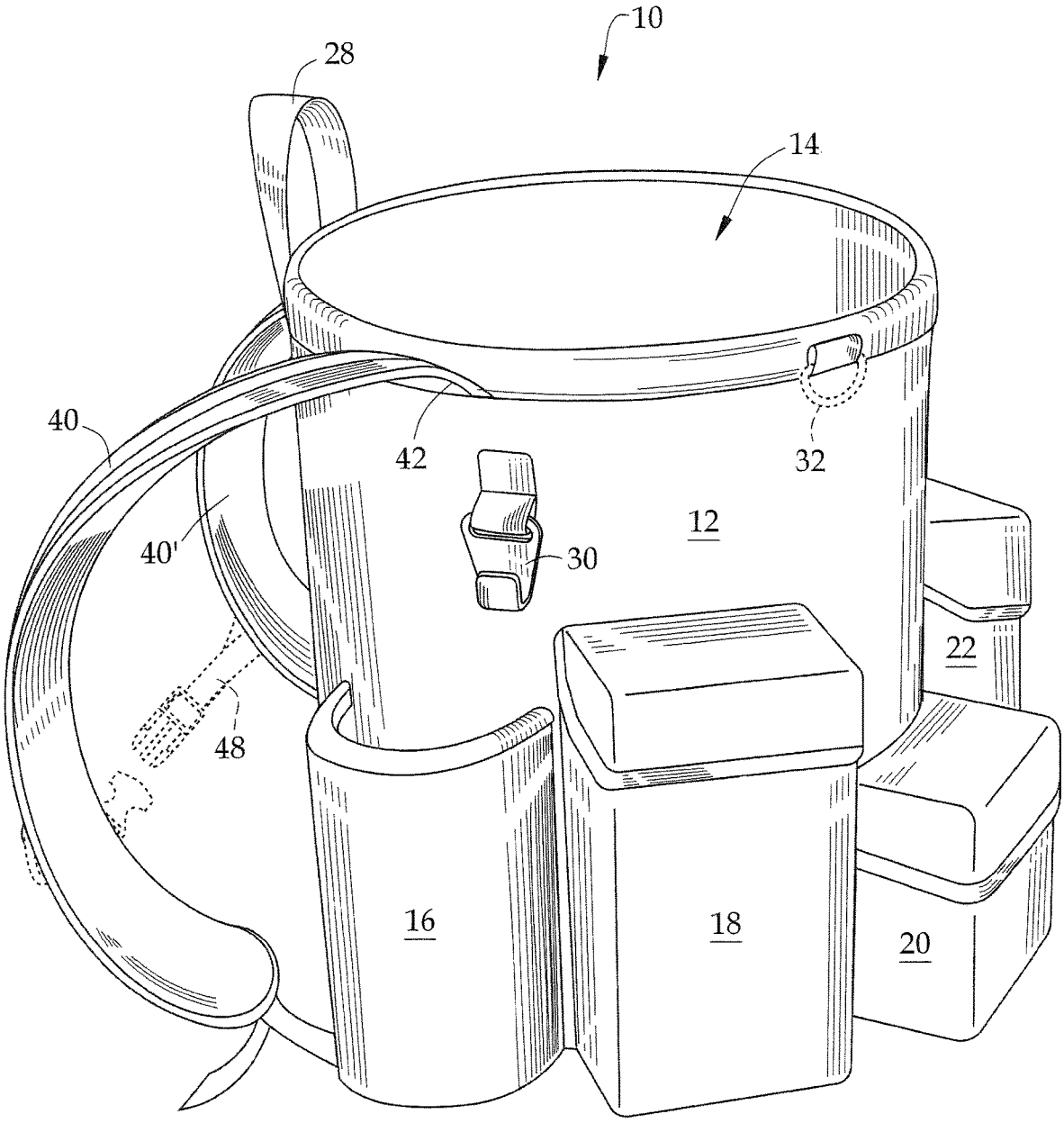
FIG. 4 is a left side perspective of the preferred embodiment of FIG. 1.
Figure 6:
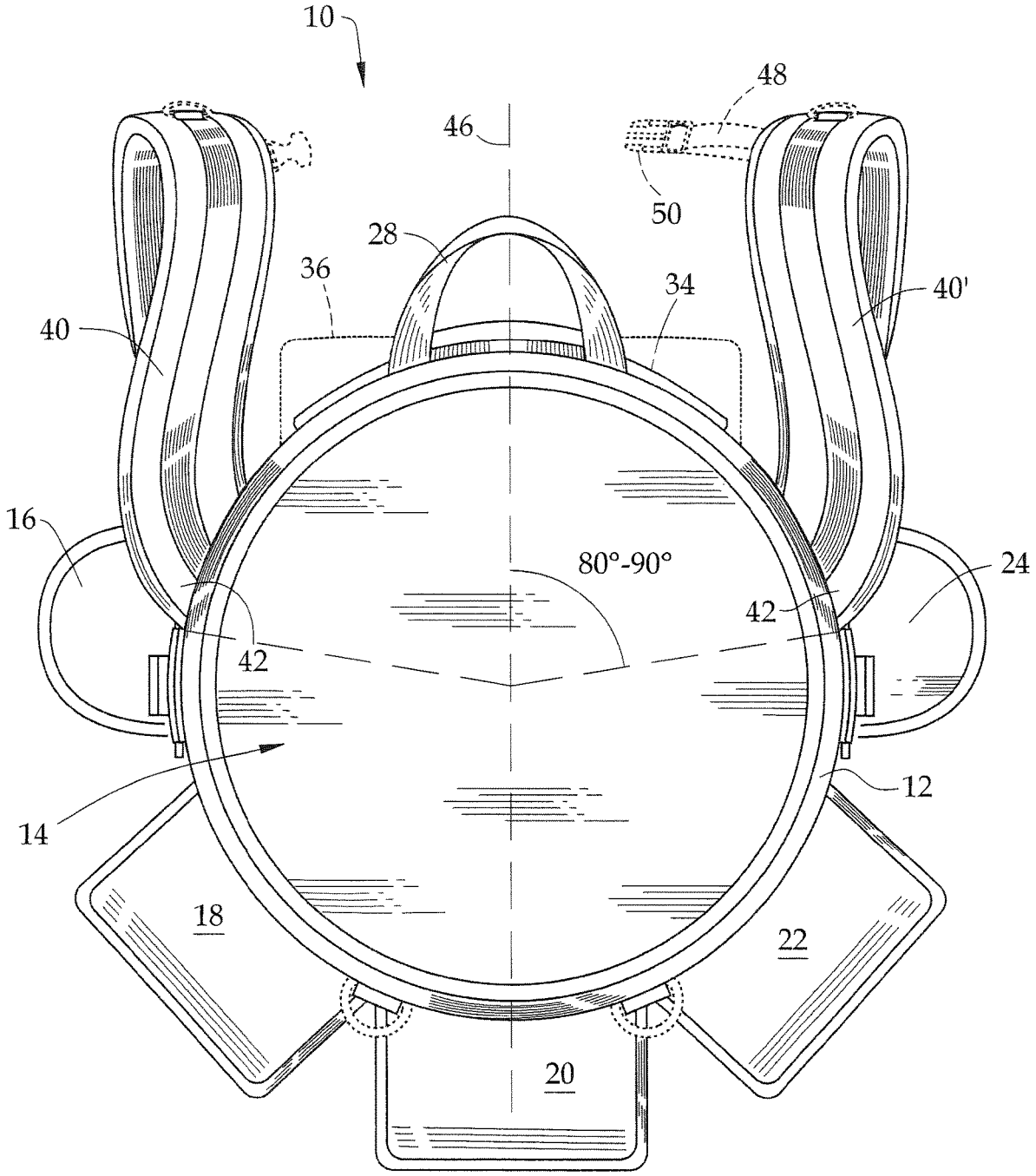
FIG. 6 is a top plan view of the embodiment of FIG. 1.
Figure 7:
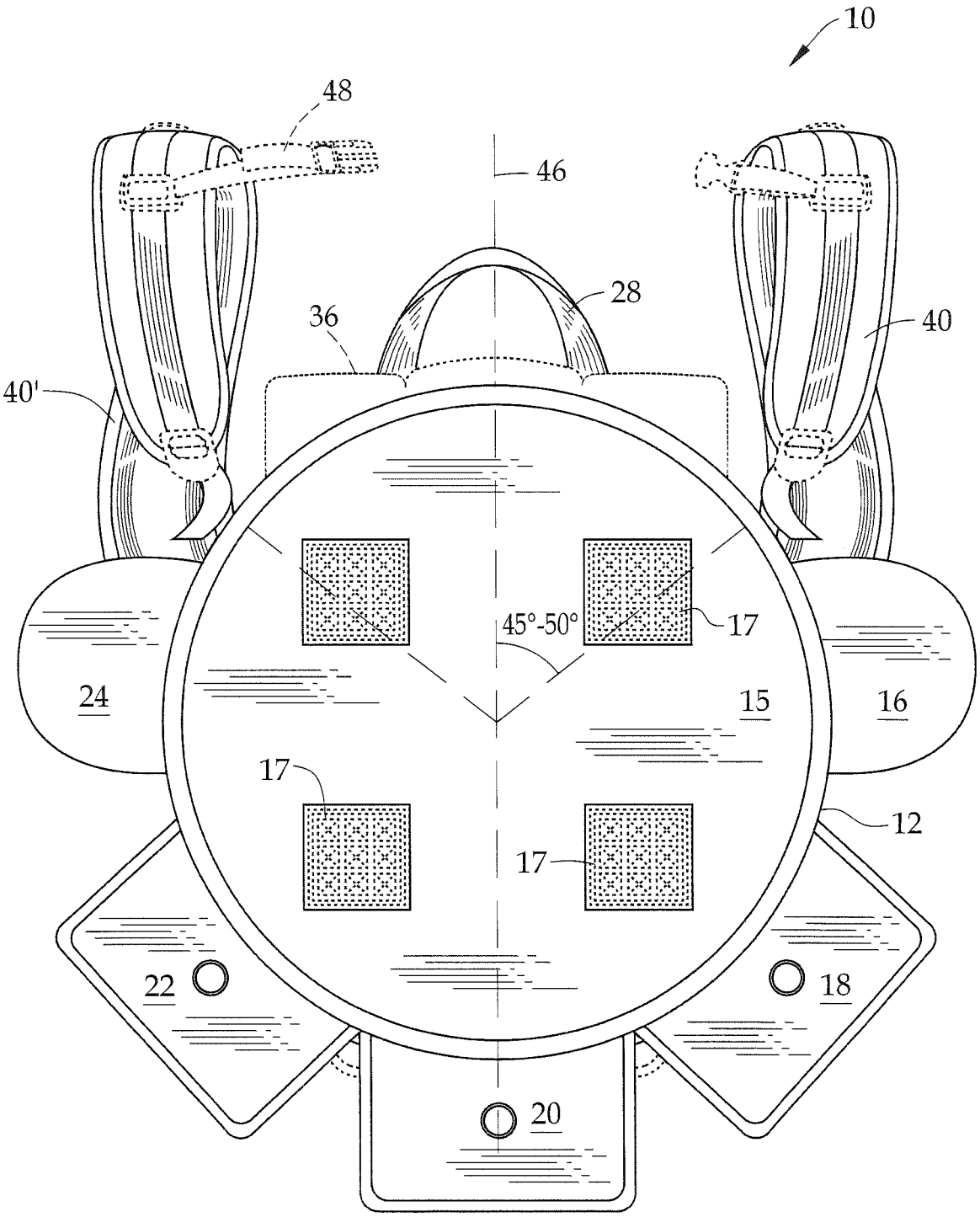
FIG. 7 is a bottom plan view of the embodiment of FIG. 1.

A bucket backpack in accordance with a preferred embodiment of the invention is illustrated in the accompanying FIGURES. With reference thereto, the bucket backpack designated generally at 10 comprises a body 12 having a generally cylindrical shape. The body 12 has an opening at the top 14 thereof and a plurality of pockets 16, 18, 20, 22, 24 disposed about the outer perimeter of the body 12. The number, size and configuration of the pockets, including whether or not the pocket is provided with a covering or closure, insulation, or one or more openings with a grommet or mesh insert for drainage, may be as desired for the particular intended application. The pockets 16, 18, 20, 22, 24 are arranged on the front, right and left sides of the body 12. As seen in FIGS. 3, 6 and 7, the back portion 26 of the body 12 is preferably free of any pockets, which can interfere with wearing the device on the back of a user.

In the embodiment shown, the body 12 is a rigid member defining a cylinder with an open top 14 and a closed bottom 15 (see FIG. 7). In other embodiments, the body 12 can be made of a flexible, durable material such as canvas and be sized to receive and cover a typical utility bucket, such as a five-gallon, six-gallon, or seven-gallon utility bucket, or other generally cylindrical container, such as a cylindrical foam container. The bottom 15 of the body may include non-slip rubber feet 17 (see FIG. 7) to frictionally engage the ground surface to provide a secured seating area during use as well as to serve as a spacer to prevent the bottom surface of bottom 15 from rubbing against the ground and causing abrasion to the same. In an exemplary embodiment body 12 of bucket backpack 10 is fully insulated.

The body 12 of bucket backpack 10 may further include one or more grab handles 28, preferably positioned at the top of the body 12, near opening 14. In addition, various hooks 30 and/or ring loops 32 may be positioned about the body 12 as desired to facilitate attachment of various items to the bucket backpack, such as a water bottle, rope, fishing pole, etc.

Figure 2:
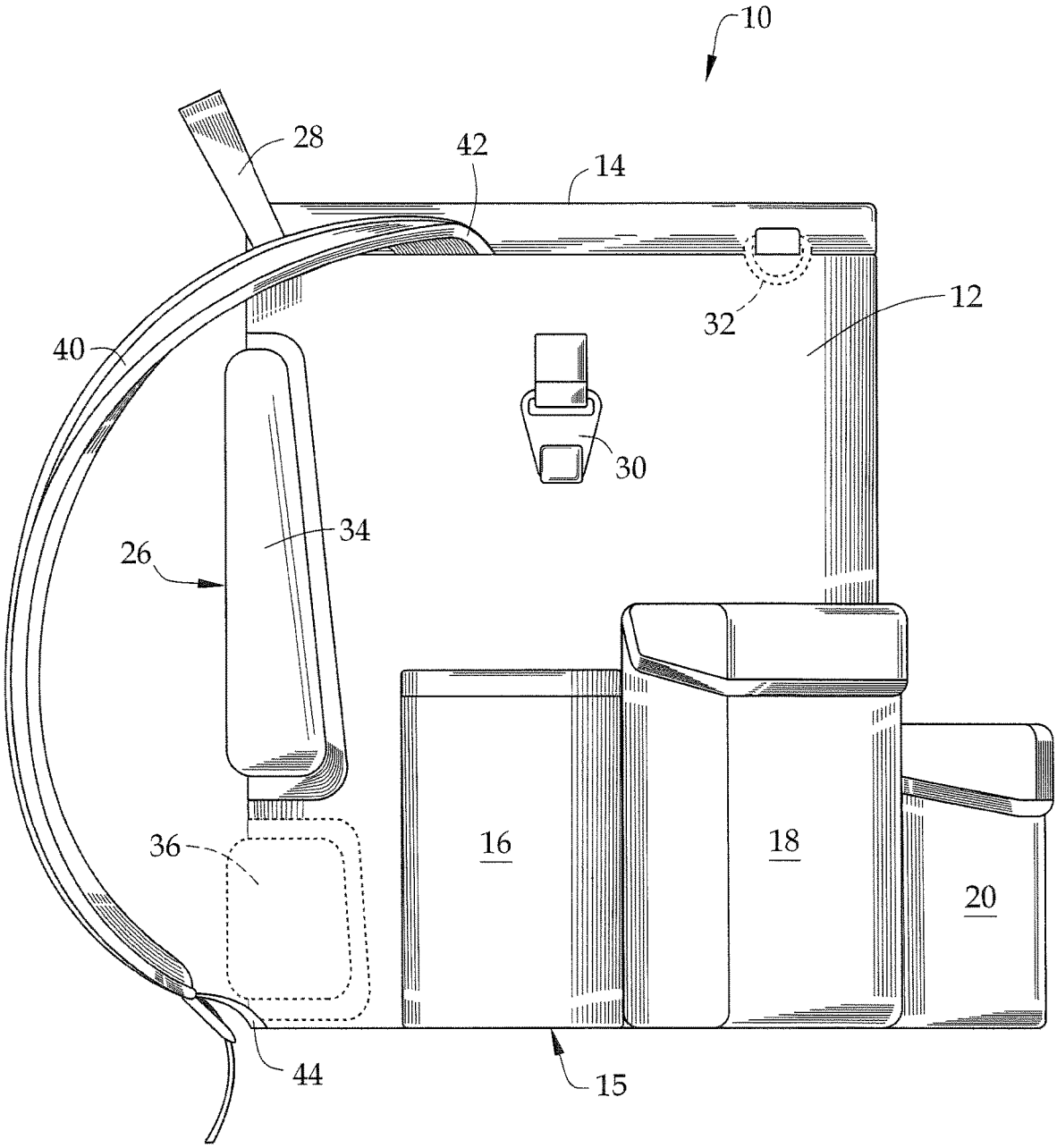
FIG. 2 is a left side elevational view of the embodiment of FIG. 1.
Figure 5:
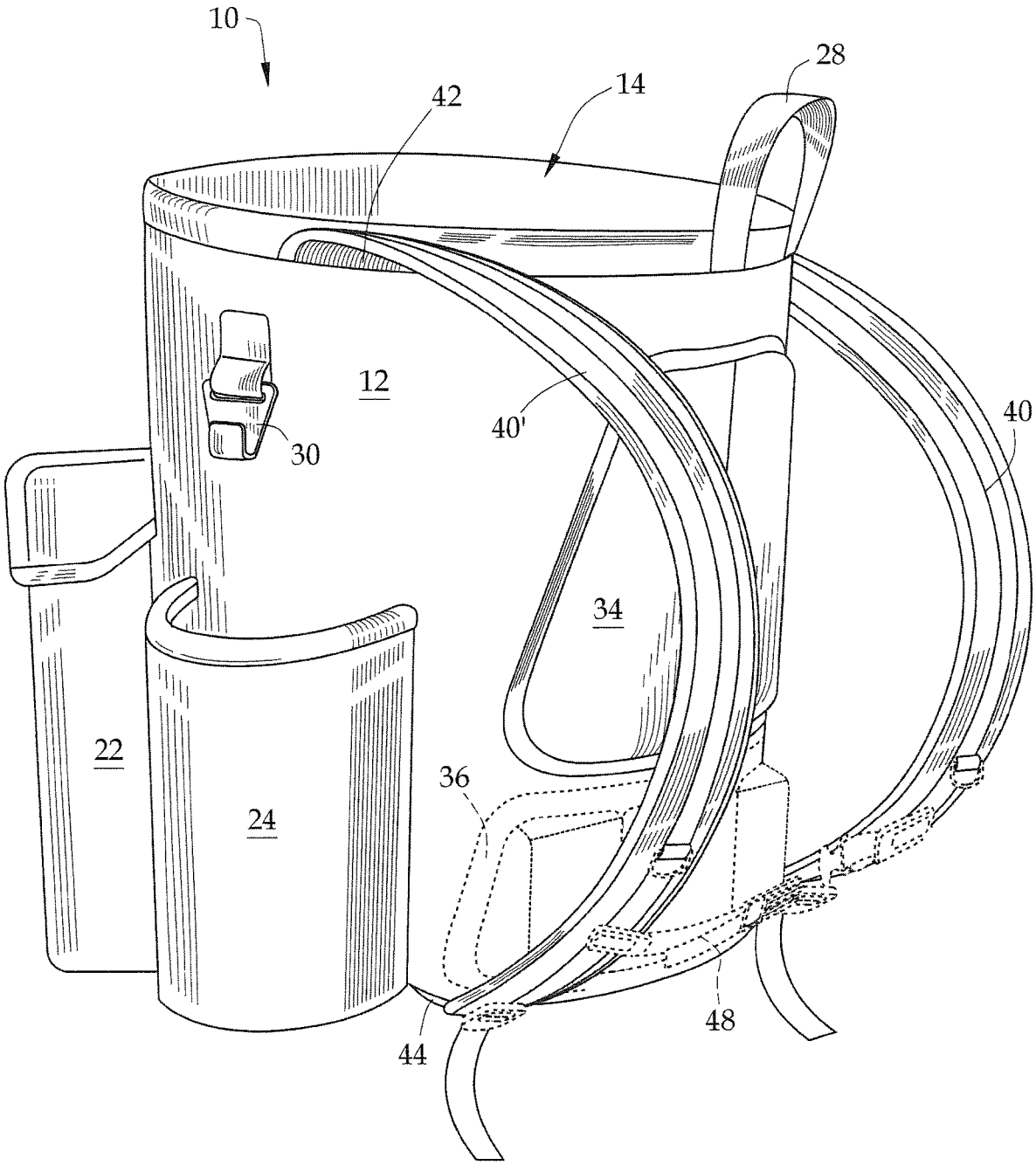
FIG. 5 is a right side perspective view of the embodiment of FIG. 1.

As best seen in FIGS. 2, 3 and 5, the back portion 26 may be provided with padded sections 34 around the upper back and padded sections 36 around the lower back to improve the comfort of the user when carrying the bucket backpack. In the preferred embodiment, the lower padded sections 36 as best seen in FIG. 7 comprise two outer, generally triangular pads and one center, substantially planar pad which are positioned towards the bottom of backpack 10 to create a generally flat surface when wrapped around the bucket, which when in use rest against the lower back to further aid in the reduction of side-to-side rolling.

The bucket backpack 10 includes a pair of padded straps 40, 40', each strap having a first end 42 and a second end 44. The first end 42 of straps 40, 40' is rigidly affixed to the top edge of the body 12 and adjacent to opening 14. The second end 44 of straps 40, 40' is affixed to the bottom edge of body 12 and adjacent to bottom 15. With particular reference to FIGS. 6 and 7, the straps 40, 40' are in spaced relationship to one another where the respective ends 42, 44 are affixed to body 12 and are symmetrical relative to a lateral center line 46 of the body 12. This orientation of straps 40, 40' relative to the lateral center line of the body 12 is no mere design choice as will be described in greater detail below.

Traditionally, the straps at the top of a bucket carrier were positioned very close to the lateral center line of the body and in some instances the tops of the individual straps touched one another and there was no separation at all in the straps at the top of the carrier. Applicants have discovered that such geometry creates several undesirable conditions. First, when the top of the straps are close together, the straps can rub against the neck of the user, causing discomfort. Second, having the straps too close together creates an imbalance in the weight distribution of a loaded backpack. The imbalance in the weight distribution results in a tendency of the top of the bucket to move away from the body, particularly in the shoulder area, which, in turn, causes the bottom of the bucket to push against the lower back. This results not only in discomfort of the user, but also instability in the load being carried. The imbalance in weight distribution also results in excessive longitudinal (i.e., up and down) and/or lateral (i.e. side to side) movement of the loaded pack, creating not only user discomfort, but also instability of the load being carried.

Accordingly, in the embodiments of the invention, the first ends 42 of straps 40, 40' are each spaced at least about eighty to ninety degrees (80°-90°) from the lateral center line 46 of the body. Stated differently, the first ends 42 of the straps 40, 40' are preferably spaced at least a hundred and sixty degrees (160°) apart from one another. In the preferred embodiment, the outermost portions of first ends 42 of the straps 40, 40' are preferably spaced between a hundred and sixty and a hundred and eighty degrees (160°-180°) apart from one another. It is the outer most portions that are most important to be aligned properly in the manner described, as it is this portion that reduces lateral torque, and thus reduces the pivoting or rolling action of the bucket and its carried load. This arrangement, as discovered by Applicants, results in an improved stabilization and support of the center of gravity of a loaded bucket relative to the prior art, and a more stable load with less discomfort and virtually no longitudinal/lateral movement of the load so during use.

The points of attachment of the second ends 44 of straps 40, 40' are also spaced from the lateral center line 46 of the body 12. The attachment point of the lower ends of the straps have typically been farther apart compared to the upper attachment points for reasons of basic anatomy: the lower straps fit on either side of the hips whereas the upper straps fit on either sides of the neck, which is considerably smaller than the hips. In the embodiments of the invention, the attachment of the second ends 44 of straps 40, 40' are spaced apart a conventional distance. In particularly preferred embodiments, the attachment points of the second ends 44 of straps 40, 40' are likewise spaced apart by at least about ninety (90) degrees and about forty-five (45) degrees on either side of the lateral center line 46 of the body 12. In the preferred embodiment, the second ends 44 of the straps 40, 40' are spaced ninety (90) degrees apart from one another.

A chest strap 48 with buckle 50 is attached to the straps 40, 40'. Chest straps are well known and serve the function of keeping the straps 40, 40' in place to help maintain proper weight distribution and load balance. While not illustrated, it will be understood that in some embodiments a padded lid or cover for the opening 14 may be utilized if the bucket backpack were to also serve as a seating implement.

An exemplary embodiment of bucket backpack 10 is fully insulated, includes three (3) separate closable pockets, two (2) insulated open side pockets, various hooks and ring loops, padded upper and lower back pads, ergonomic padded shoulder straps having an adjustable chest strap which make carrying the bucket backpack full of accessories easy and hands free. Although not shown as would be understood a drawstring may be contained within the uppermost edge of the bucket backpack such that once a bucket (not shown) is positioned therein the drawstring may be tightened under the bucket rim to prevent accidental dislodgement.

Materials used for construction of the bucket backpack are well known to those skilled in the art. Generally speaking, these materials are of the type used for typical backpack construction, however the preferred embodiments of bucket backpack 10 are formed from reinforced, durable 600 denier polyester reinforced with PVC coating or 12 ounce duck canvas having reinforced stitching at all stress points for a more durable, longer lasting carrier for use for example during dove, duck, deer, and turkey hunting, ice fishing, shore fishing, fur trapping, cooler, tailgating and more.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention.

We claim:

1. A cover for a cylindrical shaped object, said cover having a cylindrical shaped body portion with an open top and a bottom, the body portion defining a midpoint established at the center of the body portion and extending longitudinally from the open top to the bottom; said body portion having a pair of shoulder straps, said shoulder straps each having a first end with a padded portion and affixed to said body adjacent to said open top, and a second end affixed to said body adjacent to said bottom; wherein said first end of said shoulder straps are symmetrically spaced relative to a lateral center line of said body by between 80 and 90 degrees and defining a first small angle relative to the midpoint, whereby said first ends of said shoulder straps are separated from one another by between 160 and 180 degrees and defining the first small angle relative to the midpoint wherein the second ends of said shoulder straps are symmetrically spaced relative to a lateral center line of said body by forty-five degrees and defining a second small angle relative to the midpoint, whereby said second ends of said shoulder straps are separated from one another by ninety degrees and defining the second small angle relative to the midpoint.

2. The cover of claim 1, wherein said bottom of said body portion is closed.

3. The cover of claim 1, wherein said bottom of said body portion further comprises one or more feet.

4. The cover of claim 1, wherein said bottom of said body portion further comprises a plurality of rubber feet.

5. The cover of claim 1 wherein the body portion further comprises a plurality of pockets on an outer perimeter thereof.

6. The cover of claim 1 wherein the body portion further comprises a plurality of pockets on an outer perimeter thereof and wherein said bottom of said body portion further comprises a plurality of rubber feet.

7. The cover of claim 1, further comprising a chest strap, said chest strap having a first half affixed to one of the shoulder straps and a second half secured to the other shoulder strap, said chest strap further comprising a buckle for securing the first half to the second half.

8. The cover of claim 1, further comprising a chest strap, said chest strap having a first half affixed to one of the shoulder straps and a second half secured to the other shoulder strap, said chest strap further comprising a buckle for securing the first half to the second half; wherein the body portion further comprises a plurality of pockets on an outer perimeter thereof.

9. The cover of claim 1, further comprising a chest strap, said chest strap having a first half affixed to one of the shoulder straps and a second half secured to the other shoulder strap, said chest strap further comprising a buckle for securing the first half to the second half; wherein the body portion further comprises a plurality of pockets on an outer perimeter thereof; and wherein said bottom of said body portion has a plurality of rubber feet.

10. The cover of claim 1, further comprising a grab handle secured to said body portion and disposed between the spaced-apart first ends of said shoulder straps.

11. The cover of claim 1, further comprising a grab handle secured to said body portion and disposed between the spaced-apart first ends of said shoulder straps; and further comprising a chest strap, said chest strap having a first half affixed to one of the shoulder straps and a second half secured to the other shoulder strap, said chest strap further comprising a buckle for securing the first half to the second half; wherein the body portion further comprises a plurality of pockets on an outer perimeter thereof; and wherein said bottom of said body portion has a plurality of rubber feet.

12. The cover of claim 1, further comprising a plurality of padded sections attached to the body portion, said padded sections placed symmetrical relative to the longitudinal center line of said body and between the first and second ends of said shoulder straps.

13. The cover of claim 1, further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections.

14. The cover of claim 1, further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections; wherein the body portion further comprises a plurality of pockets on an outer perimeter thereof and wherein said bottom of said body portion further comprises a plurality of rubber feet.

15. The cover of claim 1, further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections; said cover further comprising a grab handle secured to said body portion and disposed between the spaced-apart first ends of said shoulder straps.

16. The cover of claim 1, further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections; said cover further comprising a chest strap, said chest strap having a first half affixed to one of the shoulder straps and a second half secured to the other shoulder strap, said chest strap further comprising a buckle for securing the first half to the second half; wherein the body portion further comprises a plurality of pockets on an outer perimeter thereof; and wherein said bottom of said body portion has a plurality of rubber feet.

17. The cover of claim 1, wherein the second ends of said shoulder straps are symmetrically spaced relative to a lateral center line of said body by forty-five degrees (45°) and defining a second small angle relative to the midpoint, whereby said second ends of said shoulder straps are separated from one another by ninety degrees (90°) and defining the second small angle relative to the midpoint; said cover further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections; said cover further comprising a chest strap, said chest strap having a first half affixed to one of the shoulder straps and a second half secured to the other shoulder strap, said chest strap further comprising a buckle for securing the first half to the second half; wherein the body portion further comprises a plurality of pockets on an outer perimeter thereof; and wherein said bottom of said body portion has a plurality of rubber feet.

18. The cover of claim 1, wherein the second ends of said shoulder straps are symmetrically spaced relative to a lateral center line of said body by forty-five degrees (45°) and defining a second small angle relative to the midpoint, whereby said second ends of said shoulder straps are separated from one another by ninety degrees (90°) and defining the second small angle relative to the midpoint; wherein said bottom of said body portion has a plurality of rubber feet; said cover further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections.

19. The cover of claim 1, wherein the second ends of said shoulder straps are symmetrically spaced relative to a lateral center line of said body by forty-five degrees (45°) and defining a second small angle relative to the midpoint, whereby said second ends of said shoulder straps are separated from one another by ninety degrees (90°) and defining the second small angle relative to the midpoint; wherein said bottom of said body portion has a plurality of rubber feet; said cover further comprising a plurality of padded sections attached to the body portion, said padded sections placed symmetrical relative to the longitudinal center line of said body and between the first and second ends of said shoulder straps; said plurality of padded sections comprising upper padded sections and lower padded sections; said lower padded sections being located at the bottom of the body portion and said upper padded sections being located above said lower padded sections; said cover further comprising a chest strap, said chest strap having half affixed to one of the shoulder straps and a second half secured to the other shoulder straps, said chest strap further comprising a buckle for securing the first half to the second half; and wherein said cover further comprises a plurality of pockets on an outer perimeter thereof.

* * * * *